US005718432A

United States Patent [19]

Fraser

[11] Patent Number: 5,718,432

[45] Date of Patent: Feb. 17, 1998

[54] LOTTERY NUMBER CARD GAME

[76] Inventor: Alfred Peter Fraser, P.O. Box 733, Renfrew, Ontario, Canada, K7V 4H2

[21] Appl. No.: 637,359

[22] Filed: Apr. 25, 1996

[30] Foreign Application Priority Data

Apr. 28, 1995 [CA] Canada ..... 2148155

[51] Int. Cl.[6] ..... A63F 1/00

[52] U.S. Cl. ..... 273/304; 273/305

[58] Field of Search ..... 273/292, 303, 273/304, 305, 306, 139, 138 R, 269

[56] References Cited

U.S. PATENT DOCUMENTS

| | | | |
|---|---|---|---|
| D. 212,239 | 9/1968 | Schick | 273/304 X |
| 516,165 | 3/1894 | Paine | 273/305 |
| 832,576 | 10/1906 | Gifford | 273/292 |
| 1,484,564 | 2/1924 | Riffert | 273/292 |
| 1,551,761 | 9/1925 | McCarroll | 273/304 |
| 4,219,197 | 8/1980 | Acuff . | |
| 4,234,189 | 11/1980 | Chunn . | |
| 4,333,656 | 6/1982 | Sommer . | |
| 4,588,193 | 5/1986 | Winston | 273/305 X |
| 4,591,162 | 5/1986 | Fakhoury | 273/306 X |
| 4,741,540 | 5/1988 | Levine . | |
| 4,775,157 | 10/1988 | Armstrong . | |
| 4,807,885 | 2/1989 | Chamblee et al. . | |
| 4,826,175 | 5/1989 | Quatrino . | |
| 4,877,255 | 10/1989 | von Braunhut . | |
| 4,923,199 | 5/1990 | Hahn . | |
| 5,199,714 | 4/1993 | Harper . | |
| 5,445,391 | 8/1995 | Gleason | 273/304 |

FOREIGN PATENT DOCUMENTS

| | | | |
|---|---|---|---|
| 424618 | 11/1993 | United Kingdom | 273/304 |

*Primary Examiner*—William E. Stoll

*Attorney, Agent, or Firm*—Killworth, Gottman, Hagan & Schaeff, L.L.P.

[57] ABSTRACT

A deck of 52 standard-sized playing cards representing a gaming system to preselect lottery numbers for submission to a variety of State lottery games in which provision has been made to exclude unwanted lottery numbers during play, allowing the full and complete deck of cards to be used for such lottery games and to allow multiple player involvement for such numbers in a novel card game to be enjoyed by the participants in a friendly, competitive, gaming atmosphere. Cards are provided with at least three different indicia, two for determining lottery numbers and another for competitive play.

12 Claims, 1 Drawing Sheet

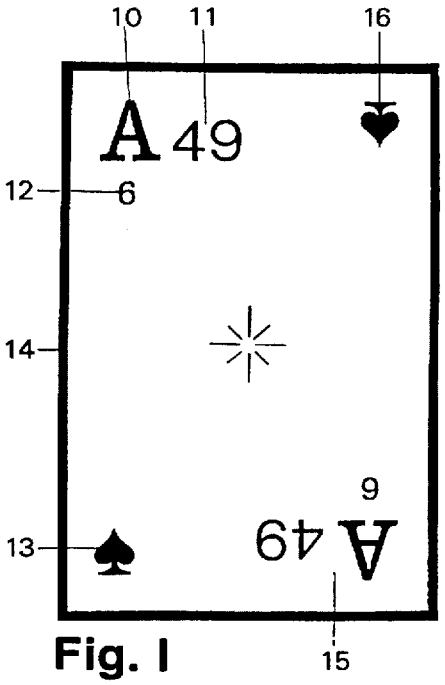
Fig. I
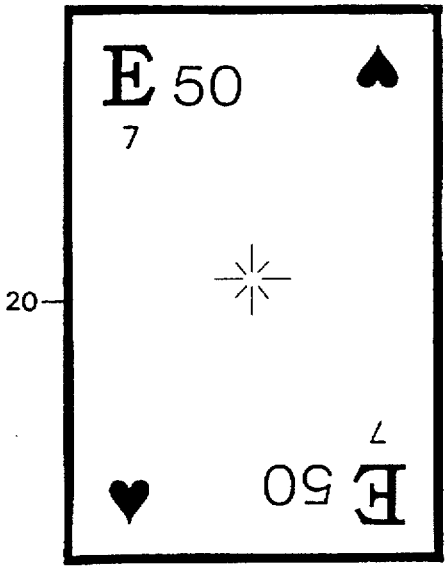
Fig. 2
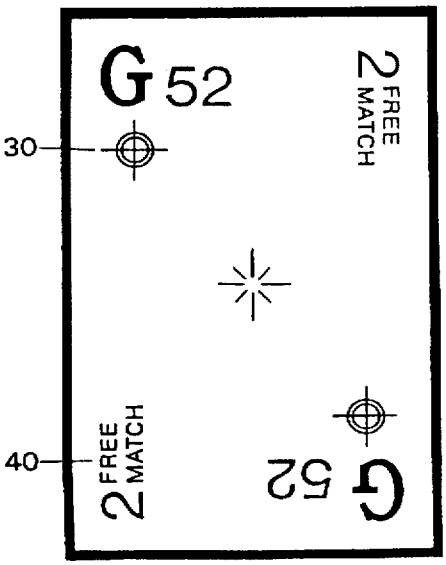
Fig. 3
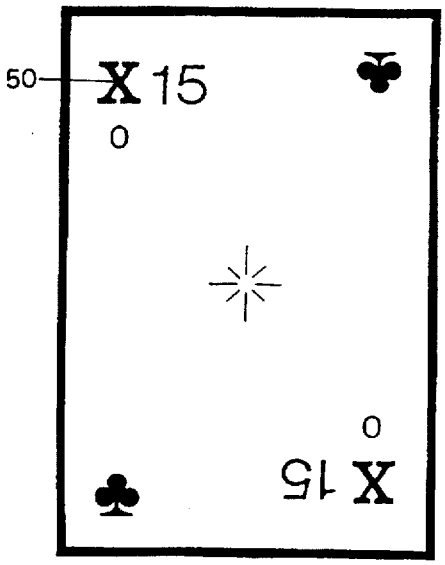
Fig. 4

LOTTERY NUMBER CARD GAME

The present invention relates to a deck of playing cards representing a gaming system to preselect State lottery numbers for a plurality of lottery games in which provision has been made to exclude unwanted lottery numbers during play, allowing the full and complete deck of playing cards to be used for such lottery number selection and to allow multiple player involvement for such numbers in a game that is challenging and entertaining.

Card games can be traced to parts of Europe as far back as 1397. At that time, one such playing card system contained 78 cards, 56 of which were numerical cards and the remainder emblematic cards. By the middle of the fifteenth century, the French has reduced this number to the now standard 52 cards displaying the four suits—hearts, diamonds, clubs and spades.

The continuing popularity and fascination in card games may be credited to two factors—entertainment and challenge. Whether it be solitaire or a group game, enjoyment and the expectation of the potential to win or lose are ever present. These are the criteria that maintains interest and brings players back to card games time and time again.

To adapt a deck of playing cards to preselect lottery numbers for a majority of State lottery games, two sets of numbers must appear on the cards. The first number series represents the primary type lottery number games where the player must select a specific number of numbers from a single number series such as selecting 6 numbers from a nonrepeating series of numbers 1 to 49.

The second set of numbers must represent the secondary type lottery games where numbers are chosen from a multiple 0 to 9 number series, an example of which is Florida's CA$H 3 lottery game where 3 numbers are selected from this repetitive 0 to 9 number series.

In a review of the most accessible playing card games designed to preselect lottery game numbers, it was found that a full range of critical features normally thought to be associated with traditional long-standing card games were lacking. An example of such features may include the challenge of competition, card versatility, a complete range of game options and the emotional features involving skill, strategy and luck.

An example of one lottery number selection game is described and illustrated in U.S. Pat. No. 4,591,162, filed Oct. 4, 1984 and granted May 27, 1986 to Joseph I. Fakhoury for a "Deck or Pack of Cards for Playing Multiple Lottery Games".

In this game, play is limited to one player and a selection of lottery numbers are produced with each hand played. To change from one lottery game to another, the player must add or delete specific cards to or from the deck to correspond with the chosen game.

Another example is described and illustrated in U.S. Pat. No. 4,741,540, filed May 1, 1987 and granted May 3, 1988 to Sidney Levine for a "Lottery Numbers Selection Game". This card game is also limited to one player with lottery numbers produced every hand and with a deck that must contain specific cards for each lottery game played. This deck displays a single lottery number series and can only be used for primary type lottery games.

To devise a viable option, two additional considerations were thought critical. To develop long-term sustainable interest, the cards should contain elements for multiple player involvement and secondly, to make the deck more user friendly, the playing cards should accommodate a number of lottery games without having to adjust the number of cards in the deck for each game.

Along with the facility to preselect lottery game numbers, this invention incorporates these two basic prerequisites within the one deck of 52 playing cards.

The invention consists of a deck of 52 playing cards designed to preselect lottery numbers for a plurality of lottery games in which all lottery, selection and gaming elements on the cards are equally represented in the deck and where each lottery number displayed thereon has an equal chance of being selected for lottery participation while using the full and complete deck of cards.

Each card of the standard sized deck shall have a front surface and a back surface. The front surface shall display the card elements on the back, or nonplaying surface of all cards shall be identical and of any preferred ornamental or graphic design.

Each card shall display one number from a 1 to 52 number series. These numbers shall represent the card number which shall be used to identify specific cards or groups of cards. As an example, part of this series 1 to 49 shall represent the numbers required in primary type lottery games.

The inventive aspect in the selection of lottery numbers is to devise a selection system to exclude all numbers from play that are not required in a specific lottery game (such as cards numbered 50, 51 & 52 in a primary type lottery game) and maintaining equal representation for all valid lottery numbers while using the entire deck of 52 cards. A major contributor to this end is found in the selection process itself.

To determine a selection of cards and the numbers thereon for lottery participation, the cards shall display individual symbols from a limited group of different symbols whereby a symbol matching between two consecutive cards during play shall identify the latter card and the number thereon for lottery participation. This process shall continue until the appropriate number of cards have been identified to correspond with a chosen State lottery game.

Each card shall display one of 5 different symbols. The symbols shall be displayed in the lower left hand corner of each card. Each symbol shall be repeated 10 times in random fashion on cards numbered 1 through 50.

The two remaining cards shall display a free-match notation instead of a symbol. When such cards are encountered during the lottery number selection process, they shall identify the next card to be played from the unused deck as a card for lottery participation.

These free-match notations shall be displayed in the lower left hand corner of cards numbered 51 & 52. During the matching process, should these two cards appear together in the deck, the second one played shall cancel the rights of the first one. The second free-match card to be played will be assumed to have matched the card that follows it. As a result of their nature, cards numbered 51 & 52 are excluded from ever being selected for lottery participation.

Referring to the exclusion of primary lottery numbers lower than number 51, card numbered 50 shall be identified as a terminator card and it shall terminate any game if it is selected for lottery participation in games involving the primary lottery number series.

Further, to facilitate primary type lottery games involving less than 49 numbers, selected cards displaying the primary lottery numbers 1 to 49 may be considered obsolete cards if unwanted numbers are selected for lottery participation when the game being played requires less than 49 primary lottery numbers. When such obsolete card/cards are selected for lottery participation, they shall immediately be replaced by the next card from the unused deck.

Referring to secondary type lottery games, each card shall display one of a 10 number 0 to 9 number series in the upper left hand corner of each card. This number series shall be repeated in random fashion 5 times on cards 1 through 50. This full complement of 50 numbers is required for all secondary type lottery games. As cards numbered 51 & 52 are excluded in the selection process from being chosen for lottery participation, no further exclusion provision is required to regulate the numbers of the secondary lottery number series.

On cards numbered 51 & 52, in place of numbers from the secondary lottery number series, the cards shall display a widow maker insignia. This insignia relates to competition play and has no bearing on the lottery number selection process.

To provide maximum family entertainment in the use of this invention, the deck encompasses elements to allow multiple player involvement by the individual random display of an alphabetical sequence on the cards, each player striving to attain the complete alphabetical sequence during play to end the hand and thereby gain point advantage towards winning the numbers derived from the lottery number selection process.

It is preferred that the alphabetical sequence displayed on the cards is represented by the letters A, B, C, D, E, F & G.

This alphabetical sequence shall be randomly displayed 7 times in the deck with one letter being displayed on each of 49 cards. The remaining 3 cards shall display the nonassociated letter 'x'.

To accommodate 'ease of play', all 3 elements displayed in the upper left hand corner of each card are inverted and repeated in form and size in the lower right hand corner of each card and the single element displayed in the lower left hand corner of each cards is inverted and repeated in form and size in the upper right hand corner of each card.

In summary, the 52 cards shall display symbols, numbers and letters in which a designated player shall play the cards one at a time to identify consecutive cards with identical symbols until sufficient cards and the numbers thereon have been identified for a specified State lottery game. At this point, all players shall participate in the game in which each player attempts to be first to complete a 7 letter alphabetical sequence to end the hand and thereby gain point advantage towards winning the numbers derived from the lottery number selection process.

The invention, as exemplified by a preferred embodiment, is described with reference to the drawings in which:

FIG. 1 is a representation of the front surface of a typical playing card in the deck of 52 cards.

FIG. 2 is a representation of the front surface of card numbered 50 referred to as the terminator card.

FIG. 3 is a representation of the front surface of a card which displays a widow maker insignia and the free-match notation, both elements being displayed on cards numbered 51 & 52.

FIG. 4 is a representation of the front surface of a card displaying the letter 'x' which is associated with cards numbered 15, 30 & 45.

Referring to the drawings, the embodiment of the invention is represented on the front surface of selected cards in FIGS. 1 to 4.

FIG. 1 is a typical playing card with a large alphabetical letter 10 in the upper left hand corner of the card. This letter is part of a 7 letter alphabetical sequence (A to G) which is repeated 7 times in the deck. During competition play, each player strives to attain the complete alphabetical sequence to end the hand and thereby gain point advantage.

Also in the upper left hand corner and to the immediate right of the letter is the card number 11 represented by a nonrepeating number series 1 to 52. The card number is used for reference purposes to identify specific cards or groups of playing cards.

This series of numbers also represents lottery numbers for all primary type lottery games in which a specific number of numbers must be selected from a single number series. An example of such a lottery would be Florida's LOTTO lottery in which 6 numbers must be selected from a nonrepeating 1 to 49 number series.

The third element in the upper left hand corner of the card and displayed below the letter is a series of 10 numbers 12 0 to 9 repeated 5 times in the deck on cards numbered 1 through 50. This number series represents the numbers of secondary type lottery games, an example of which is Florida's CA$H 3 lottery in which 3 numbers are selected from this multiple number series.

In a duel role, this number series also represents points scored by players in competition play.

Appearing in the lower left hand corner of the card is a symbol 13 representing one of five different symbols which are repeated 10 times on cards numbered 1 through 50. These 5 symbols may be represented by any variety of indicia. However, for the purpose of illustration, the symbols shall be represented by a circle and the four standard playing card suits—hearts, diamonds, clubs and spades.

In a preliminary selection process, cards are turned face up on a table (or like surface) one at a time by a designated player. When two symbols match on consecutive playing cards, the latter card displaying the second of the two symbols shall be selected for lottery participation. All selected cards, and the appropriate numbers thereon, shall be accumulated until sufficient cards have been selected to represent the numbers corresponding with the numbers required in a known lottery game.

In a primary type lottery game where the number series required is less than 49 numbers, cards displaying unwanted numbers shall be considered obsolete cards. These obsolete cards shall hereinafter be referred to as maverick cards. By way of illustration, in the primary lottery game 6/45, six numbers must be selected from a nonrepeating 1 to 45 number series.

In this instance, playing cards numbered 46 through 49 would be considered maverick cards. The specific card 14 illustrated in FIG. 1 would represent a maverick card in a 6/45 primary type lottery game. When a maverick card is selected for lottery participation, it shall immediately be replaced by the next card from the unused deck.

To accommodate 'ease of play', all 3 elements displayed in the upper left hand corner of each card are inverted and repeated in form and size in the lower right hand corner 15 of each card and the single element displayed in the lower left hand corner of each card is inverted and repeated in form and size in the upper right hand corner 16 of each card.

FIG. 2 specifically depicts the terminator playing card 20. When selected for lottery participation in a primary type lottery game, card numbered 50 shall immediately terminate that game.

This card however, displays a valid letter of the 7 letter alphabetical sequence, a valid number from the secondary type lottery number series and a valid symbol used in the lottery selection process. As a result, this card, numbered 50, has a terminating effect only in the process of selecting primary lottery numbers.

FIG. 3 is representative of 2 elements that are displayed on cards numbered 51 & 52.

The first element is a widow maker insignia 30 which has a special connotation during competition play. When either card numbered 51 or 52 is included in a completed alphabetical sequence, it will score the player an additional point advantage. If a player gets 'stuck' with a widow maker card in hand when a competitor goes out, it will have the opposite effect.

The second element is the free-match notation 40 which appears on the two cards in place of a symbol. As the name implies, when a free-match card is encountered during the number selection process, the card that follows the free-match card is considered to have been matched. The number on this latter card shall be included with other match symbol cards for lottery participation.

FIG. 4 is representative of one of the 3 cards which display an 'x' 50 in place of a letter from the 7 letter alphabetical sequence. In competition play, an 'x' card is a neutral card without point value.

Following is a detailed description of the fundamental procedures used to adapt this invention to a number of card games. The first three are for playing lottery number card games with 3 or more players, then two players and lastly, a solitaire game. The remaining three card games are designed for family entertainment without the lottery aspect included.

GAME 1—LOTTERY NUMBER CARD GAME—3 OR MORE PLAYERS:

METHOD OF PLAY: This game centers around the sequence of alphabetical letters A to G displayed in the upper left hand corner of the cards. A designated player will start the deal. The deal will then pass in clockwise order after each hand.

Each player is dealt 6 cards. The remaining deck is placed in the center of the table, face down. The player to the immediate left of the dealer will take one card from the top of the unexposed deck and then discard one card.

The next player may then pick up the discarded card or draw one card from the unexposed deck. This player must then discard one card. The object of the game is to assemble a lay down hand consisting of the complete sequence of letters—A, B, C, D, E, F & G.

To achieve a 7 card lay down hand from a 6 card hand, a player must assemble all but one of the A to G sequence cards during his or her turn of play. When the last card presents itself to complete the sequence, the player will immediately lay down all 7 cards and the hand will be over for all players.

A second method of achieving a lay down hand is to assemble 6 like symbols during competition play. Free-match symbols may constitute one or two of the 6 symbols needed to form a complete lay down hand of 6 cards.

At any time, should the unexposed deck expire before completion of the hand, the top card of the discard pile will remain exposed and the remainder of the discard pile shall be shuffled and placed face down so that the game may continue in the normal fashion.

GAME WINNER: The 'prize' to the winner of the game shall be a selection of lottery numbers associated with a known State lottery game. These numbers shall be predetermined in the following manner.

Prior to participation by all players, the first designated dealer will shuffle the deck and proceed to turn the cards face up on the table, one card at a time. Each time symbols are matched on consecutive cards, the latter of the two cards shall be set aside until sufficient cards have been selected to represent the designated lottery game. Once sufficient cards have been identified, the selection process is immediately discontinued. When a free-match card is played, it is assumed to have matched the card that follows it.

If the designated dealer fails to produce the required number of cards in the selection process for the lottery game specified by the end of the deck, the deal shall pass to the next player on the left who will then proceed to select new lottery numbers.

The appropriate numbers on the selected cards will then be transferred to a lottery 'selection slip' which shall represent the 'prize' to be awarded to the winner of the game.

MAVERICK CARDS: In selecting a primary lottery game such as 6/45, cards displaying the numbers 46 through 49 shall be considered maverick cards. Should a maverick card be selected for lottery participation in a primary lottery game, it will immediately be replaced by the next card from the unused deck. This maverick rule shall apply as required for all primary type lottery games.

All games require the use of the full deck of playing cards. At no time shall cards be deleted from the deck because they represent unwanted lottery number cards.

TERMINATOR CARD: Should the terminator card numbered 50 be selected for lottery participation in any primary type lottery game through the matching of symbols, the designated dealer will lose his or her turn and must discontinue lottery card selection. The cards will then pass to the player to the immediate left who will determine new lottery numbers before proceeding with the card game.

'x' CARDS: Cards numbered 15,30 & 45 do not contain letters of the alphabetical sequence A to G, but rather display the nonassociated letter 'x'. During play, when a player discards a card marked with the letter 'x', the next player will lose one turn. The 'x' card may be picked up by the following player if he or she so desires.

WIDOW MAKER CARDS: Cards 51 & 52 display a widow maker insignia under the letter in the upper left hand corner of the cards instead of displaying a number from the 0 to 9 number series.

A widow maker card may be used in completing an A to G sequence, used in a 6 card symbol hand or it may be discarded. To discard a widow maker card, the player must first call "Widow Maker" and then place it on the discard pile before drawing a card during regular play.

If a player mistakingly discards a widow maker card or touches the deck or the discard pile in any fashion before stating "Widow Maker", he or she cannot then discard the widow maker card. It must be held by that player for another turn.

In disposing of a widow maker card, the discard pile is frozen to the player making the discard as the widow maker card must be discarded before another card is picked up. The next player may pick up the widow maker card or draw from the unexposed deck.

If a widow maker card is picked up from the unexposed deck during regular play, it must be held in the hand for one turn, after which it may be disposed of in the prescribed manner.

SCORES: Scores will be based on penalty points rather than points. The player with the lowest score after 10 hands shall be considered the winner of the game.

POINT SYSTEM: If a player is caught with any pair (letters) at the end of a hand, penalty points will be assessed according to the 0 to 9 number series appearing immediately below the letters of such pair. If a player's hand contains an unplayed widow maker card after the hand has been completed, its value is 20 penalty points.

Should a player go out using a widow maker card in any lay down hand, all other players will be assessed 20 penalty points in addition to any points that may be in each hand.

CONSIDERATION: On completion of the game (10 hands), the player with the lowest score will be awarded the lottery 'selection slip'.

The player with the highest score at that time will have lost the game and must pay the winner any compensation agreed to prior to commencement of the game. An example of such compensation may be the cost of registering the lottery 'selection slip'.

If two players are matched evenly with a high score at the end of the game, they will share the liability of the agreed compensation. If two players are matched evenly with low score, the game is considered 'in deadlock' with no winner and no loser.

GAME 2—LOTTERY NUMBER CARD GAME—2 PLAYERS:

With the exception of the following, all the rules of Game 1 shall apply when the lottery number card game is played by two participants.

a) The players must draw all cards from the unexposed deck in the center of the table and shall not take any cards from the discard pile.

b) If a player discards an 'x' card, that same player shall immediately play again, in effect, making his or her opponent miss one turn.

GAME 3—LOTTERY NUMBER CARD GAME—SOLITAIRE:

PLAY AREA: Using a table or some such surface, cards shall be laid down one at a time to compare card symbols. This immediate surface shall be called the play area.

CONTROL ZONE: When card symbols match on consecutive cards, the latter of the two cards shall be placed above the play area in what shall be called the control zone.

METHOD OF PLAY: Once the cards have been shuffled, the first card in the dec{ is placed face up in the play area. The next card is turned over in the hand and noted. If the symbol on these two cards do not match, the second card drawn is placed on top of the first card played.

At any time, if a match is achieved between the symbols, the card in hand shall be placed in the control zone rather than placed to cover the card with the matching symbol before it. This method of play immediately separates like symbols so that paired symbols do not accrue in the deck from one game to the next.

If three like symbols appear on three consecutive cards, only the second of the three cards shall be placed in the control zone. One symbol cannot be used with two other symbols. Four like symbols on consecutive cards shall place two cards in the control zone.

WINNING HAND: To achieve a win, a minimum of 9 cards must appear in the control zone by the end of the deck.

The first group of cards placed in the control zone shall represent the lottery numbers for the lottery game being played. The balance of the required 9 cards shall be the validating cards.

As an example, in the game 6/49, the first 6 cards placed in the control zone shall represent the numbers for lottery participation. To validate these numbers, a minimum of 3 additional cards must appear in the control zone by the end of the deck.

When less than 9 cards appear in the control zone once all cards in the deck have been played, the game has been lost.

TERMINATOR CARD: There is only one card in the deck that can terminate a game and this only applies to primary type lottery games. If terminator card numbered 50 appears in the control zone in any primary type lottery game, the game will be terminated immediately.

MAVERICK CARDS: In the primary lottery game 6/49, all lottery number cards 1 to 49 are required and there are no maverick cards in the deck. In playing any lottery game where all of these numbers are not required, the excess cards will remain in the deck but shall be considered maverick cards.

To illustrate this point, in the primary lottery game 7/47, cards numbered 48 & 49 are not required in the primary number series and therefore shall be considered maverick cards. When a maverick card is placed in the control zone, it shall immediately be replaced by the next card from the unused deck.

FREE-MATCH CARDS: In the lottery number selection process, when a free-match card is played, the next card to be played is considered to have been matched and is placed in the control zone.

Should the two free-match cards appear together in the deck, the second one played will cancel the rights of the first one. Free-match cards shall never be placed in the control zone.

FOUR LEVEL PLAY: To increase the challenge of the game, four levels of play have been established to allow the player to regulate the number of win situations that will be encountered. Level 1 being the easiest to win and level 4 being the hardest to win.

To accomplish this, two special cards appear in the deck. Card numbered 51 is a level 1 free-match card and card numbered 52 is a level 2 free-match card.

In a level 1 game, the player will accept a free symbol match with both cards numbered 51 & 52.

Moving to level 2, when card numbered 51 is played, it will be ignored. The player shall only accept a free match with card numbered 52.

In level 3 play, both cards numbered 51 & 52 will be ignored when played. At this level, the player is without the benefit of any free-match cards. As usual, to win the game, 9 or more cards must appear in the control zone after all cards have been played.

If the player chooses the level 4 game, both free-match cards shall be ignored and the control zone must contain exactly 9 cards after all cards in the deck have been played or the game is considered lost.

SYMBOL MATCHING (An example of what you might expect.)

Number of wins per hundred games in all levels of play.

| Statistic | 500 games 6/49 | 300 games 7/47 | 300 games 6/45 | 100 games 6/39 | 100 games *6/39 |
|---|---|---|---|---|---|
| Level 1 | 40 | 28 | 35 | 18 | 34 |
| Level 2 | 24 | 17 | 22 | 10 | 22 |
| Level 3 | 12 | 10 | 6 | 3 | 10 |
| Level 4 | 5 | 5 | 4 | 2 | 5 |

*6/39 - If it is desirable to increase the win situation in the 6/39 primary lottery game, the number of cards required in the control zone may be reduced from 9 to 8 cards.

GAME 4—ENTERTAINMENT ONLY—3 OR MORE PLAYERS:

METHOD OF PLAY: All the rules of Game 1 will apply except that the lottery card selection process is not required at the beginning of the game.

PARTNERS: Game 4 may be played with partners when 4 people are participating. In this case, when one player goes out, the three remaining players (including the partner), are assessed penalty points according to their hands.

The player going out is not allowed to receive any indication or signals from his or her partner that it is o.k. to go out. Any obvious indication of this being the case, the partners who failed to comply with this basic rule will be assessed an extra 20 penalty points on the hand.

VARIATION: For an evening of entertainment, the players may switch partners at the end of each hand. The game must consist of a sufficient number of hands so that each player has been partnered with each of the other contestants the same number of times. Individual scores will be kept for each participant and the player with the lowest score at the end of the game shall be the overall winner.

GAME 5—ENTERTAINMENT ONLY—2 PLAYERS:

METHOD OF PLAY: Refer to Game 2 for the special rules for playing with two players. As in Game 4, the players will ignore the lottery card selection process at the beginning of the game.

GAME 6—ENTERTAINMENT ONLY—SOLITAIRE:

This is a word game involving the matching of symbols to identify alphabetical letters from which the words may be found. With the use of the free-match cards, four level play is compatible with this game.

METHOD OF PLAY: Game 3 outlines the process of placing cards in the control zone. These same rules should be followed.

Cards appearing in the control zone after all cards in the deck have been played shall be examined for words that can be derived from the lettered sequence A to G, plus the letter 'x', appearing in the upper left hand corner of the cards.

Only words with 4 or more letters may be considered. Following is a list of words that may be used in the game.

| | | | | | | | |
|---|---|---|---|---|---|---|---|
| aged | bead | beef | cage | cade | cafe | cede | dead |
| dace | deaf | deed | egad | feed | fade | face | gaff |
| gaga | gage | adage | addax | adder | badge | cadge | accede |
| decade | deface | exceed | efface | cabbage | ABCDEFG | | |

Points will be scored for each word according to the value of the 0 to 9 number series appearing immediately below each letter of the word.

Each game shall consist of 10 hands. The object of play is to achieve the highest score possible by the completion of the game. After the player has established a high score from previous games, he or she will be in competition to beat that high score.

When spelling a word, all letters must appear in the control zone including the duplicates. In other words, cards containing the letters FED cannot be used to spell FEED. One more card containing a second E must appear in the control zone to spell this word.

SPECIAL CARDS:

Maverick cards are not a factor in this game.

Using a widow maker card in a word—score 20 points.

Using an 'x' card in a word—score 10 points.

Using the terminator card in a word—score the value of the letter plus 10 bonus points.

What is claimed is:

1. A deck of cards for selecting lottery numbers of either a first type in which a predetermined group of numbers is selected from a set of numbers or a second type in which a predetermined number of digits are selected to form a single number, the deck comprising:

a plurality of cards, each card having a first number selected from a first sequence of numbers;

said plurality of cards subdivided into a plurality of suits, each card of a particular suit having a symbol indicative thereof and a second number selected from a second sequence of numbers and a plurality of additional cards, the plurality of additional cards having a symbol different from the symbols indicative of the suit and only the first number wherein the second sequence of numbers for one suit is interrupted by a second plurality of cards.

2. A deck of cards as claimed in claim 1 wherein the second sequence of numbers is 0 through 9 and on said second plurality of cards the second number is 0.

3. A deck of cards as claimed in claim 1 wherein said second plurality of cards have an alphabetic indicia not associated with the set of letters.

4. A deck of cards as claimed in claim 3 wherein the non-associated indicia is an X.

5. A deck of cards for selecting lottery numbers of either a first type in which a predetermined group of numbers is selected from a set of numbers or a second type in which a predetermined number of digits are selected to form a single number, the deck comprising:

a plurality of cards, each card having a first number selected from a first sequence of numbers;

said plurality of cards subdivided into a plurality of suits, each card of a particular suit having a symbol indicative thereof and a second number selected from a second sequence of numbers; and a plurality of additional cards, the plurality of additional cards having a symbol different from the symbols indicative of the suit and only the first number wherein the plurality of cards have a letter selected from a set of letters that is randomly distributed throughout the suits of cards.

6. A deck of cards as claimed in claim 5 wherein the set of letters is A, B, C, D, E, F, G.

7. A deck of cards for selecting lottery numbers of either a first type in which a predetermined group of numbers is selected from a set of numbers or a second type in which a predetermined number of digits are selected to form a single number, the deck comprising:

a plurality of cards, each card having a first number selected from a first sequence of numbers;

said plurality of cards subdivided into a plurality of suits, each card of a particular suit having a symbol indicative thereof and a second number selected from a second sequence of numbers; and a plurality of additional cards, the plurality of additional cards having a symbol different from the symbols indicative of the suit and only the first number wherein the plurality of cards have a letter selected from a set of letters that is sequentially distributed throughout the deck.

8. A deck of cards as claimed in claim 7 wherein the sequence is A, B, C, D, E, F, G.

9. A deck of cards for selecting lottery numbers comprising:

fifty-two cards, each card having a unique number selected from a first sequence of numbers from 1 to 52;

the fifty-two cards divided into five suits, each suit having ten cards and each card of a suit having a symbol indication of the suit and a number selected from a sequence of numbers from 0 to 9 and each card of the deck, except for three cards, having a letter from the sequence A–G.

10. A deck of cards as claimed in claim 9 wherein cards numbered 51 and 52 have a free-match label and symbol.

11. A deck of cards as claimed in claim 9 wherein the three cards have the letter X in place of the letter of the sequence A–G and the three cards having the letter X have the number 0 from the sequence of numbers 0 to 9.

12. A deck of cards as claimed in claim 11 wherein the three cards having the letter X have numbers 15, 30 and 45 from the first sequence of numbers.

* * * * *